US009174330B2

(12) United States Patent
Chen

(10) Patent No.: US 9,174,330 B2
(45) Date of Patent: Nov. 3, 2015

(54) BRAKE CYLINDER ADJUSTMENT ASSEMBLY

(71) Applicant: Shu-Hui Chen, Taichung (TW)

(72) Inventor: Shu-Hui Chen, Taichung (TW)

( * ) Notice: Subject to any disclaimer, the term of this patent is extended or adjusted under 35 U.S.C. 154(b) by 285 days.

(21) Appl. No.: 13/956,388

(22) Filed: Aug. 1, 2013

(65) Prior Publication Data

US 2015/0033914 A1 Feb. 5, 2015

(51) Int. Cl.
*B25B 27/00* (2006.01)

(52) U.S. Cl.
CPC ..... *B25B 27/0035* (2013.01)

(58) Field of Classification Search
CPC B25B 27/00; B25B 27/0035; B25B 27/0042; F16D 65/0043
USPC ..... 81/52, 484, 128
See application file for complete search history.

(56) References Cited

U.S. PATENT DOCUMENTS

| | | | | |
|---|---|---|---|---|
| 1,705,582 | A * | 3/1929 | May | 81/128 |
| 6,095,017 | A * | 8/2000 | Long | 81/176.15 |
| 6,574,846 | B1 * | 6/2003 | Kang | 29/239 |
| 7,194,948 | B2 * | 3/2007 | Liu | 91/454 |
| 8,661,638 | B2 * | 3/2014 | Chen | 81/52 |

* cited by examiner

*Primary Examiner* — Hadi Shakeri

(57) ABSTRACT

A brake cylinder adjustment assembly for adjusting brake cylinders of different sizes and includes a rotation unit and a driving unit which is connected with the rotation unit. The rotation unit includes a rotatable disk, a fixed disk, at least two positioning rods and a clip. The rotatable disk has at least two curved slots and the fixed disk has at least two slide slots. The at least two positioning rods are engaged with the at least two slide slots and the at least two curved slots. The brake cylinder adjustment assembly uses a single driving unit and single rotation unit to adjust the left and right brake cylinders of different sizes.

3 Claims, 9 Drawing Sheets

BRAKE CYLINDER ADJUSTMENT ASSEMBLY

FIELD OF THE INVENTION

The present invention relates to a brake cylinder adjustment assembly, and more particularly, to a brake cylinder adjustment assembly using single driving unit and single rotation unit to adjust the left and right brake cylinders of different sizes.

BACKGROUND OF THE INVENTION

The conventional brake adjustment assembly is disclosed in Taiwan Publication No. 392552, and generally comprises a disk which is axially connected with the brake cylinder, and a wrench which is connected to the shaft of the rotation disk. The rotation disk has a hollow and cylindrical positioning shaft extending from the center thereof and the outer diameter of the positioning shaft is sized to be fit the diameter of a central recess at the outer side of the piston of the brake cylinder. Two pivotal holes are defined diametrically in the rotation disk. A positioning hole is defined in an outside of the rotation disk so that a positioning rod is positioned at the positioning hole. The wrench has a driving disk at the distal end of the wrench and a recess is defined in the center of the driving disk. A magnet is accommodated in the recess. Two rods are provided at two sides of the recess of the driving disk and located corresponding to the pivotal holes of the rotation disk so that the driving disk can be easily connected with the rotation disk. By this way, the positioning shaft of the rotation disk is inserted into the central recess of the piston of the brake cylinder, and the positioning rod contacts one notch at the outer side of the piston of the brake cylinder. Therefore, the brake cylinder can be quickly adjusted. The brake cylinder adjustment assembly is accommodated in a tool box 1 as shown in FIG. 1, and there are two wrenches 10, 11 and multiple rotation disks 12 prepared in the tool box 1. The wrench 10 has right threads defined in its threaded rod 100, and the other wrench 11 has left threads defined in its threaded rod 110, so as to respectively adjust the right and left brake cylinders. It is noted that the wrenches are expensive, and the two wrenches 10, 11 and the multiple rotation disks 12 accommodated in the tool box 1 make the tool box 1 heavy and bulky.

The present invention intends to provide a brake cylinder adjustment assembly which can solve the shortcomings of the conventional ones.

SUMMARY OF THE INVENTION

The present invention relates to a brake cylinder adjustment assembly and comprises a rotation unit for being connected with the brake cylinders of different sizes, and a driving unit for being cooperated with the rotation unit. The rotation unit comprises a rotatable disk, a fixed disk, two positioning rods and a clip. The rotatable disk has two curved slots defined at one side thereof and a through hole is defined centrally through the rotatable disk. The fixed disk has two slide slots extending from a first side to a second side thereof and two positioning slots are defined at the second side of the fixed disk and located corresponding to the slide slots. A protrusion extends from the second side of the fixed disk and can be inserted through the through hole of the rotatable disk. The protrusion has a polygonal hole defined therein and a groove is defined at an outer surface of the protrusion. The clip is engaged with the groove. The two positioning rods are engaged with the two slide slots of the fixed disk. Each of the positioning rods has a positioning flange at one end thereof and the two respective positioning flanges are engaged with the positioning slots of the fixed disk. Each of the positioning flanges has a guide extending therefrom which is engaged with the curved slot corresponding thereto.

The driving unit comprises an operation rod, a left positioning socket, a right positioning socket, a board and a driving rod. The operation rod has a left threaded section and a right threaded section respectively formed at left and right sections thereof. A left hole is defined through the operation rod and located close to one end of the left threaded section. A right hole is defined through the operation rod and located close to one end of the right threaded section. A polygonal left end part and a polygonal right end part respectively extend from two ends of the operation rod. The left end part has a left positioning bead retractably engaged with one side thereof, and the polygonal right end part has a right positioning bead retractably engaged with one side thereof. The left positioning socket has inner threads defined therein and the right positioning socket has inner threads defined therein. The left positioning socket and the right positioning socket are respectively and threadedly connected to the left threaded section and the right threaded section. The left positioning socket has a first flange and the right positioning socket has a second flange. The board has a notch. The left positioning socket or the right positioning socket is engaged with the notch of the board. The driving rod can be inserted through the left hole or the right hole of the operation rod.

Preferably, the operation rod has an annular protrusion provided at a middle section thereof and an annular groove is defined at an outer surface of the annular protrusion. A fixed socket is mounted to the middle section of the operation rod. The fixed socket has a polygonal outer body and a passage is defined axially through the fixed socket. A lip extends from an inner surface of the fixed socket, which defines the passage, and is engaged with the annular groove of the annular protrusion.

Preferably, the rotatable disk has an anti-slip surface defined at a circumference thereof.

The present invention uses only one driving unit and one rotation unit to adjust the brake cylinders of different sizes. The present invention is able to adjust the left and right brake cylinders to reduce users' economical burden and the brake cylinder adjustment assembly of the present invention is compact and light so as to be carried conveniently.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
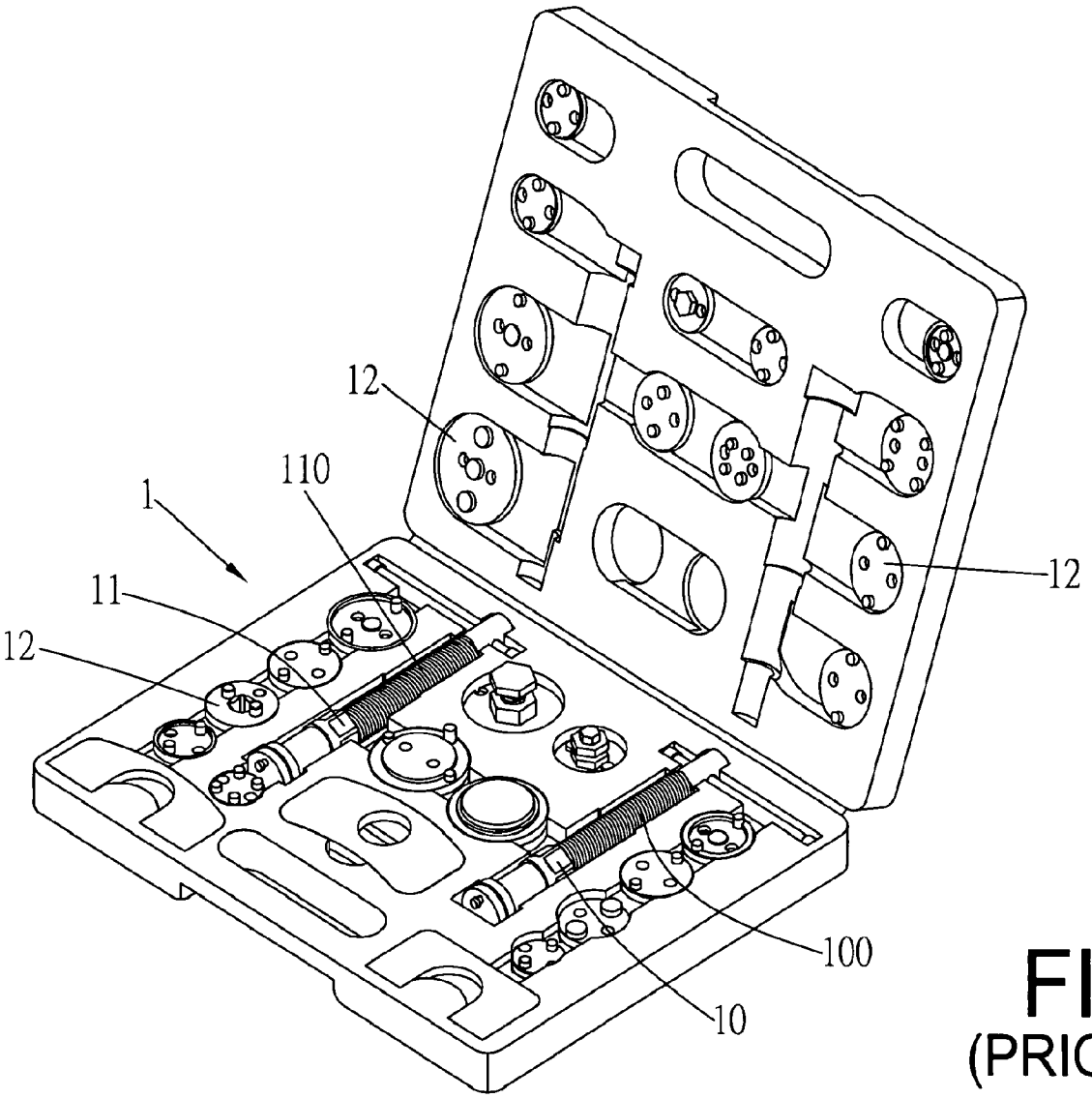
FIG.1 (PRIOR ART)
FIG. 1 is a perspective view to show the tool box for receiving the conventional brake cylinder adjustment assembly.
Figure 2:
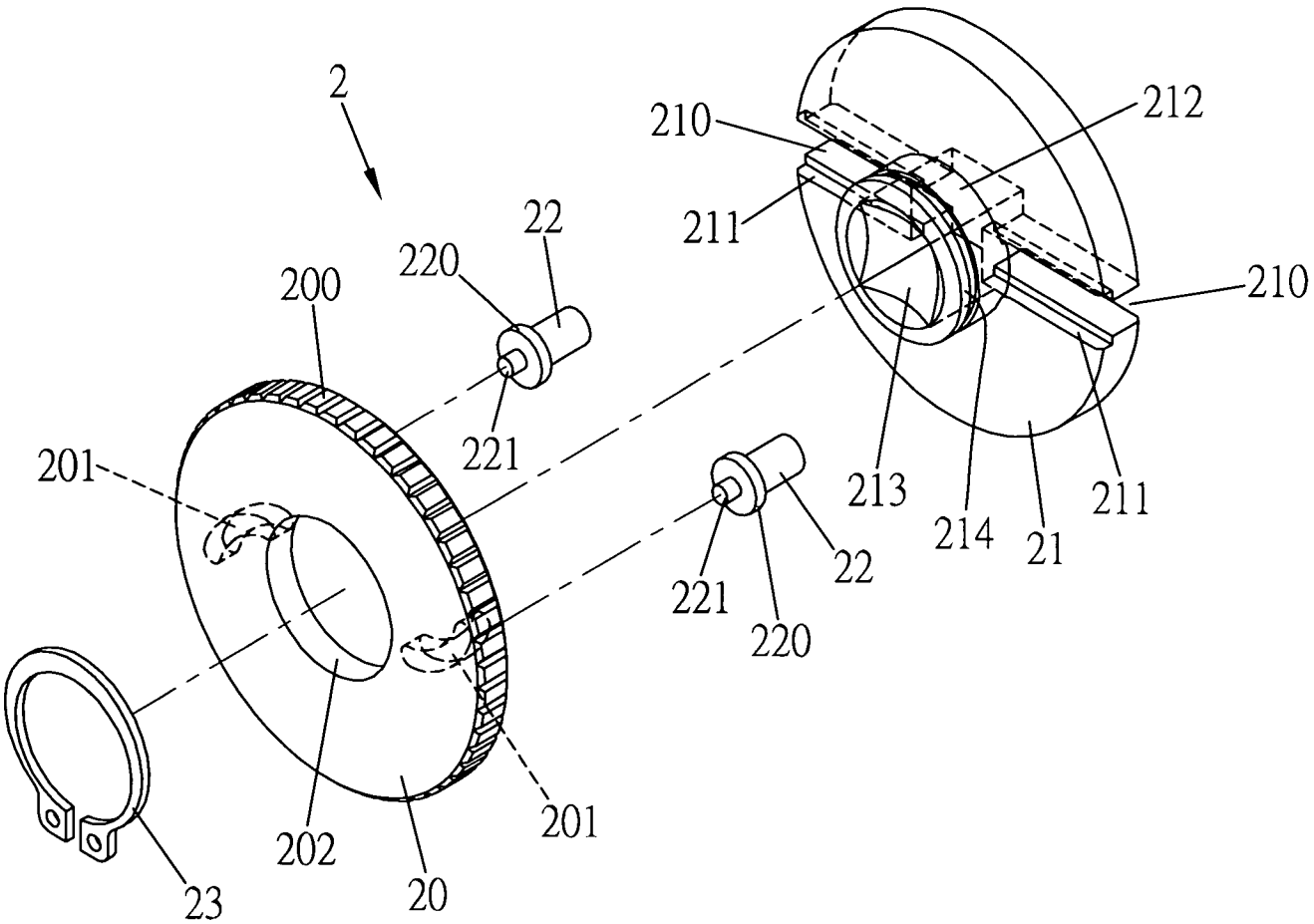
FIG. 2 is an exploded view to show the rotation unit of the brake cylinder adjustment assembly of the present invention.
Figure 3:
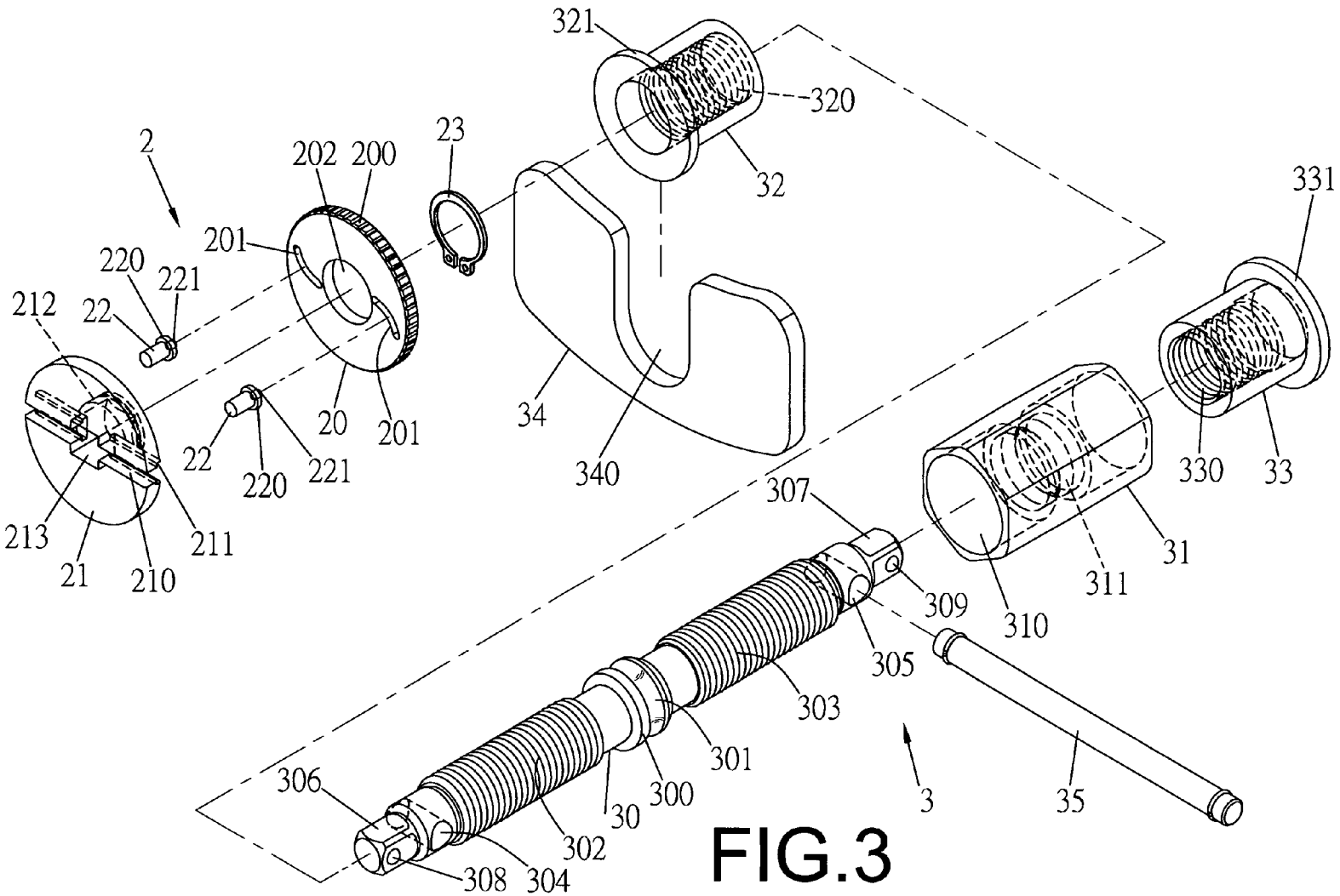
FIG. 3 is an exploded view to show the rotation unit and the driving unit of the brake cylinder adjustment assembly of the present invention.

Referring to FIGS. 2 and 3, the brake cylinder adjustment assembly of the present invention comprises a rotation unit 2 for being connected with the brake cylinders of different sizes, and a driving unit 3 for being cooperated with the rotation unit 2. The rotation unit 2 comprises a rotatable disk 20, a fixed disk 21, two positioning rods 22 and a clip 23. The rotatable disk 20 has an anti-slip surface 200 defined at a circumference thereof. The rotatable disk 20 has two curved slots 201 defined at one side thereof and a through hole 202 is defined centrally through the rotatable disk 20. The fixed disk 21 has two slide slots 210 extending from a first side to a second side thereof and two positioning slots 211 are defined at the second side of the fixed disk 21 and located corresponding to the slide slots 210. A protrusion 212 extends from the second side of the fixed disk 21 and can be inserted through the through hole 202 of the rotatable disk 20. The protrusion 212 has a polygonal hole 213 defined therein and a groove 214 is defined at an outer surface of the protrusion 212. The clip 23 is engaged with the groove 214. The two positioning rods 22 are engaged with the two slide slots 210 of the fixed disk 21. Each of the positioning rods 22 has a positioning flange 220 at one end thereof and the two respective positioning flanges 220 are engaged with the positioning slots 211 of the fixed disk 21. Each of the positioning flanges 220 has a guide 221 extending therefrom which is engaged with the curved slot 201 corresponding thereto.

The driving unit 3 comprises an operation rod 30, a fixed socket 31, a left positioning socket 32, a right positioning socket 33, a board 34 and a driving rod 35. The operation rod 30 has an annular protrusion 300 provided at a middle section thereof and an annular groove 301 is defined at an outer surface of the annular protrusion 300. The operation rod 30 has a left threaded section 302 and a right threaded section 303 respectively formed at left and right sections thereof. A left hole 304 is defined through the operation rod 30 and located close to one end of the left threaded section 302. A right hole 305 is defined through the operation rod 30 and located close to one end of the right threaded section 303. A polygonal left end part 306 and a polygonal right end part 307 respectively extend from two ends of the operation rod 30. The polygonal left end part 306 and the polygonal right end part 307 can be optionally and respectively engaged with the polygonal hole 213 of the fixed disk 21. The left end part 306 has a left positioning bead 308 retractably engaged with one side thereof, and the polygonal right end part 307 has a right positioning bead 309 retractably engaged with one side thereof. The fixed socket 31 is mounted to the middle section of the operation rod 30 and has a polygonal outer body. A passage 310 is defined axially through the fixed socket 31. A lip 311 extends from an inner surface of the fixed socket 31, which defines the passage 310, and is engaged with the annular groove 301 of the annular protrusion 300. The left positioning socket 32 has inner threads 320 defined therein and the right positioning socket 33 has inner threads 330 defined therein. The left positioning socket 32 and the right positioning socket 33 are respectively and threadedly connected to the left threaded section 302 and the right threaded section 303. The left positioning socket 32 has a first flange 321 and the right positioning socket 33 has a second flange 331. The board 34 has a notch 340. The left positioning socket 32 or the right positioning socket 33 is engaged with the notch 340 of the board 34. The driving rod 35 can be inserted through the left hole 304 or the right hole 305 of the operation rod 30.

Figure 4:
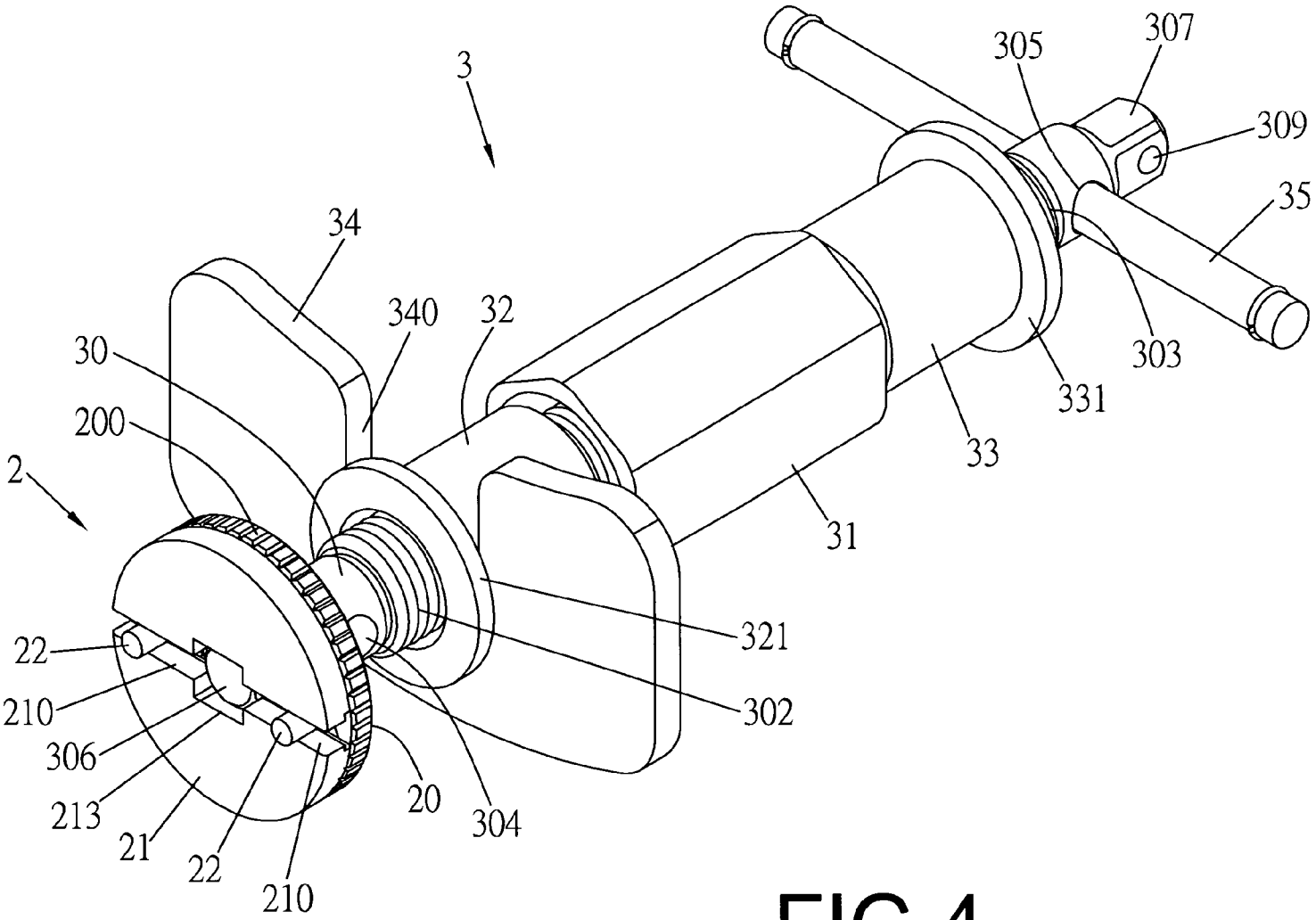
FIG. 4 is a perspective view to show the brake cylinder adjustment assembly of the present invention.

When assembling, as shown in FIGS. 2 to 4, the two positioning rods 22 are engaged with the two slide slots 210 of the fixed disk 21 and the positioning flanges 220 are engaged with the positioning slots 211. The rotatable disk 20 is matched to the fixed disk 21 so that the protrusion 212 of the fixed disk 21 is inserted through the through hole 202 of the rotatable disk 20. The guides 221 of the two positioning rods 22 are engaged with the curved slots 201 of the rotatable disk 20. The clip 23 is engaged with the groove 214 of the protrusion 212 of the fixed disk 21 to complete the assembly. The fixed socket 31 is mounted to the middle section of the operation rod 30 to engage the lip 311 of the fixed socket 31 with the annular groove 301 of the annular protrusion 300 to position the fixed socket 31 to the operation rod 30. The left positioning socket 32 is threadedly connected to the left threaded section 302 of the operation rod 30, and the right positioning socket 33 is threadedly connected to the right threaded section 303 of the operation rod 30. The board 34 is positioned beneath the left positioning socket 32 or the right positioning socket 33. The driving rod 35 is inserted through the left hole 304 or the right hole 305 of the operation rod 30 to complete the assembly of the driving unit 3. The left end part 306 of the operation rod 30 or the right end part 307 of the operation rod 30 of the driving unit 3 is inserted into the polygonal hole 213 of the fixed disk 21. By the contact between the left positioning bead 308 or the right positioning bead 309 and the inside of the polygonal hole 213 of the fixed disk 21, the driving unit 3 is easily connected to the rotation unit 2.

Figure 6:
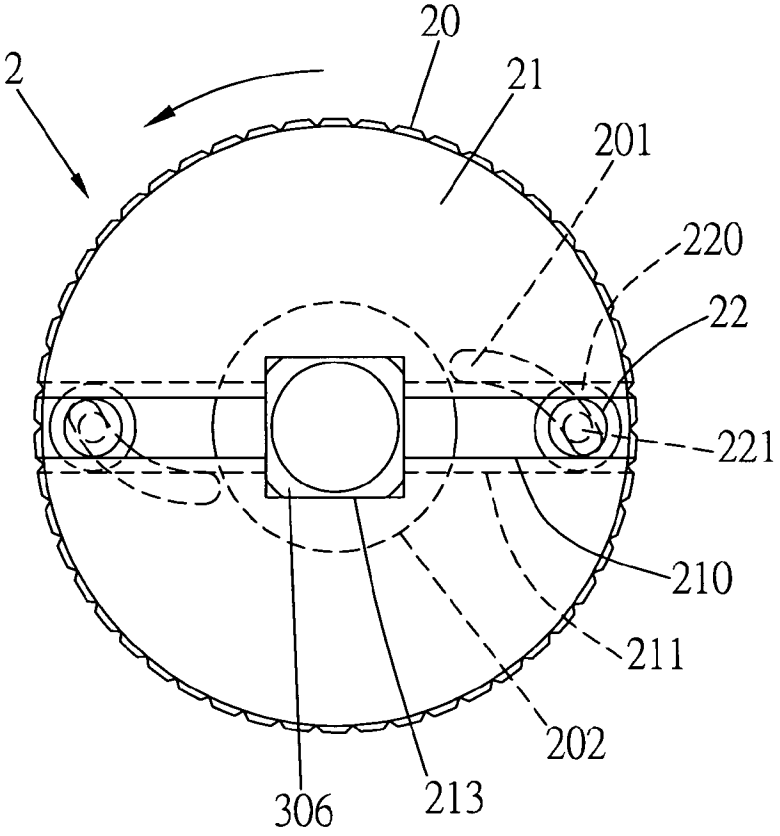
FIG. 6 shows that the two positioning rods of the rotation unit move outward to increase the distance therebetween.
Figure 5:
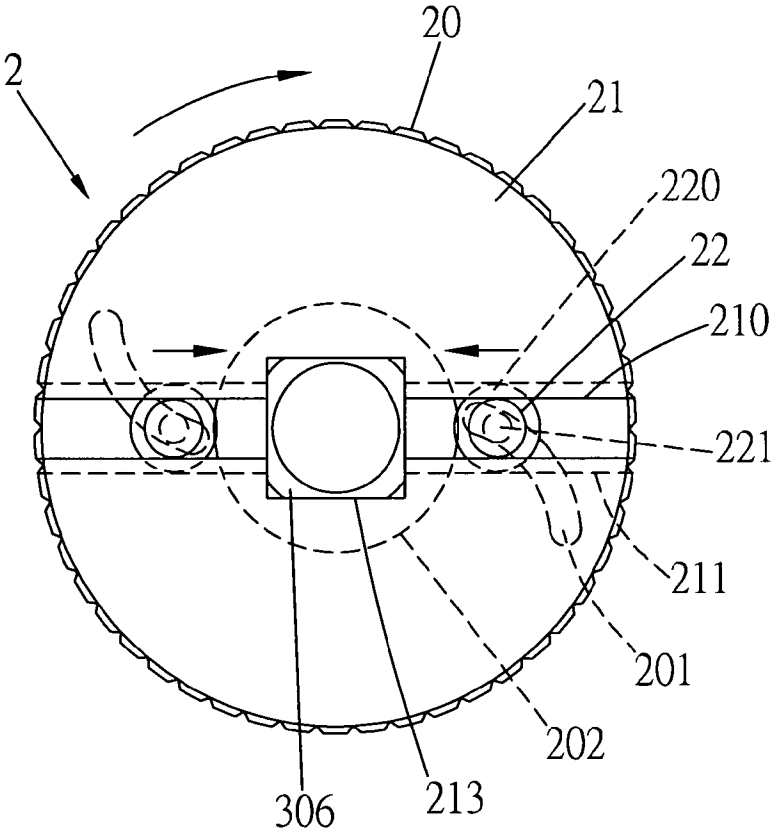
FIG. 5 shows that the two positioning rods of the rotation unit move inward to reduce the distance therebetween.
Figure 7:
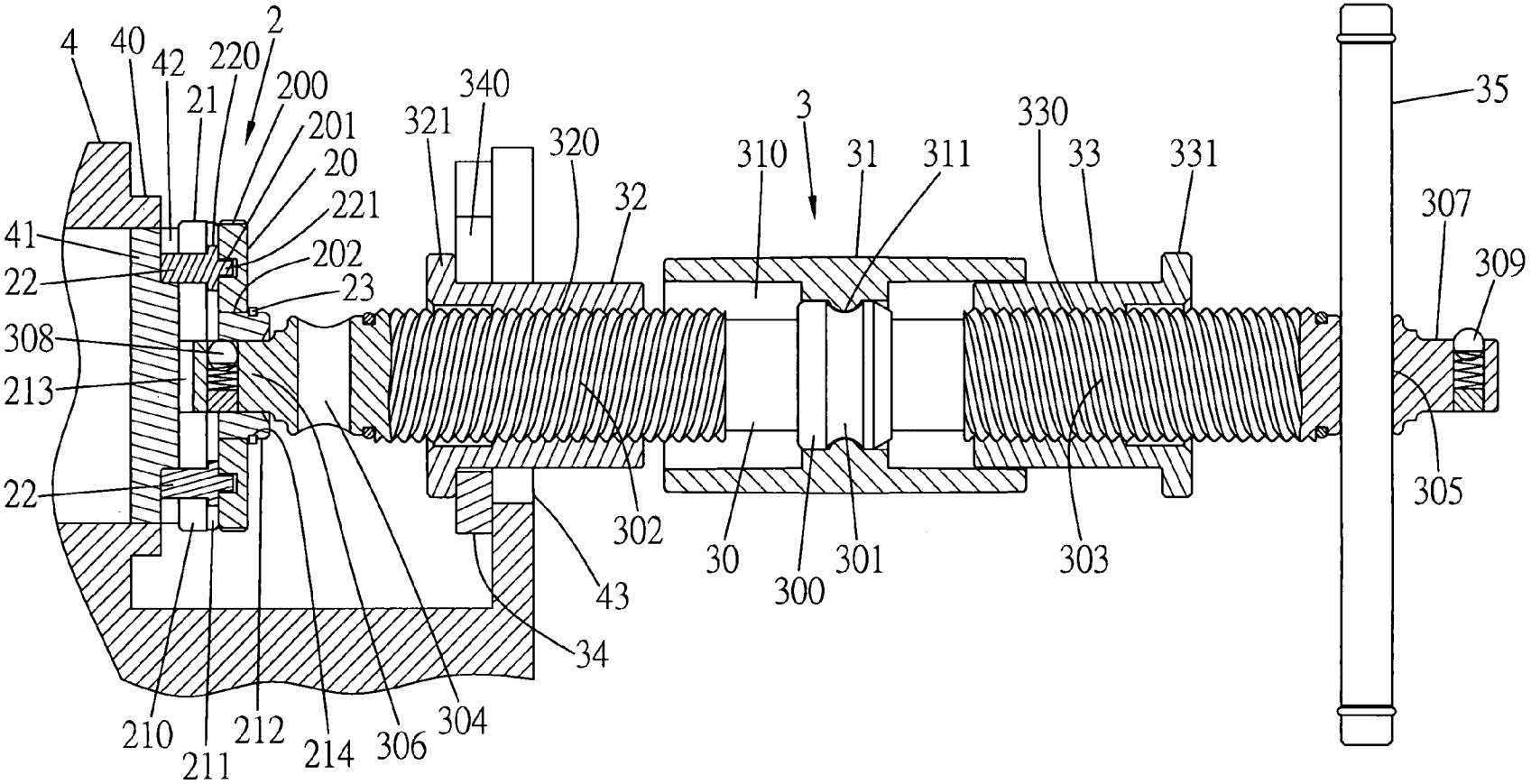
FIG. 7 is a cross sectional view to show the brake cylinder adjustment assembly of the present invention cooperated with the left brake cylinder.
Figure 8:
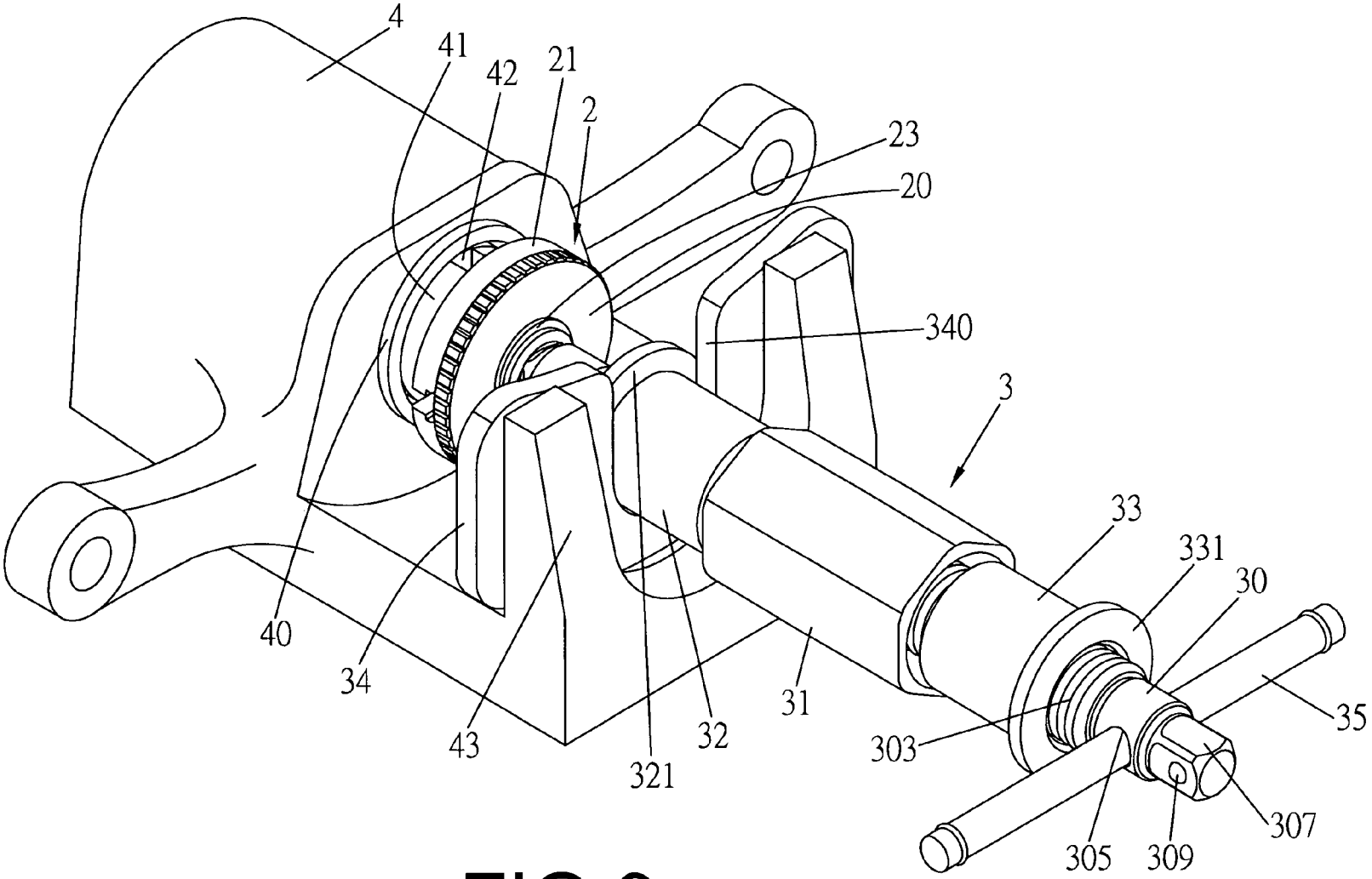
FIG. 8 is a perspective view to show the brake cylinder adjustment assembly of the present invention cooperated with the left brake cylinder.

When the left brake cylinder 4 is to be adjusted as shown in FIGS. 4 to 8, the rotatable disk 20 of the rotation unit 2 is rotated and the guides 221 of the two positioning rods 22 are moved with the curved slots 201 of the rotatable disk 20. The two positioning rods 22 can only move linearly due to the straight slide slots 210 as shown in FIGS. 5 and 6, so that the distance between the two positioning rods 22 can be adjusted according to the size of the piston 41 in the bore 40 of the left brake cylinder 4. After the distance between the two positioning rods 22 is set, the rotation unit 2 is then connected to the left end part 306 of the operation rod 30 of the driving unit 3. The left positioning bead 308 of the left end part 306 is pushed inward by the inside of the polygonal hole 213, so that the left positioning bead 308 of the left end part 306 contacts the inside of the polygonal hole 213, and the rotation unit 2 is firmly connected to the left end part 306 of the driving unit 3. The board 34 is then connected to the caliper body 43 of the left brake cylinder 4 to connect the driving unit 3 and the left positioning socket 32 to the left brake cylinder 4. The left positioning socket 32 is engaged with the notch 340 of the board 34 and the caliper body 43 of the left brake cylinder 4. The positioning rods 22 of the rotation unit 2 are located corresponding to the recesses 42 of the outer side of the piston 41 of the left brake cylinder 4, and the left positioning socket 32 is rotated along the left threaded section 302 of the operation rod 30. By the rotation of the left positioning socket 32 to move the operation rod 30 back or forth to have the rotation unit 2 on the left end of the operation rod 30 properly urged against the piston 41 in the bore 40 of the left brake cylinder 4. Besides, the driving rod 35 is inserted through the right hole 305 of the operation rod 30 of the driving unit 3 so that the user holds the driving rod 35 to rotate the operation rod 30 of the driving unit 3 so that the operation rod 30 moves rotationally forward to drive the rotation unit 2 to move the piston 41 back to its initial position to complete the adjustment to the left brake cylinder 4.

Figure 9:
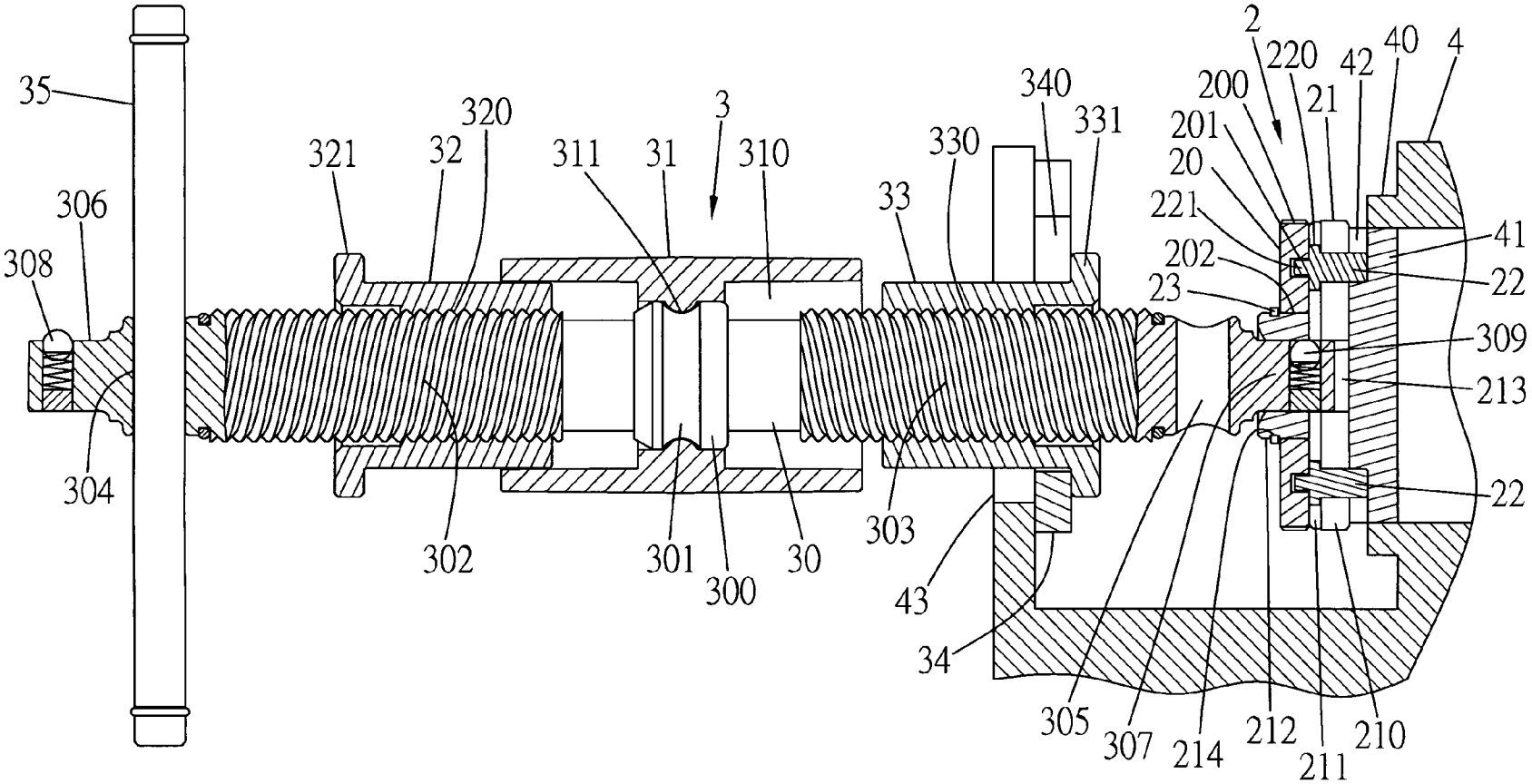
FIG. 9 is a cross sectional view to show the brake cylinder adjustment assembly of the present invention cooperated with the right brake cylinder.
Figure 10:
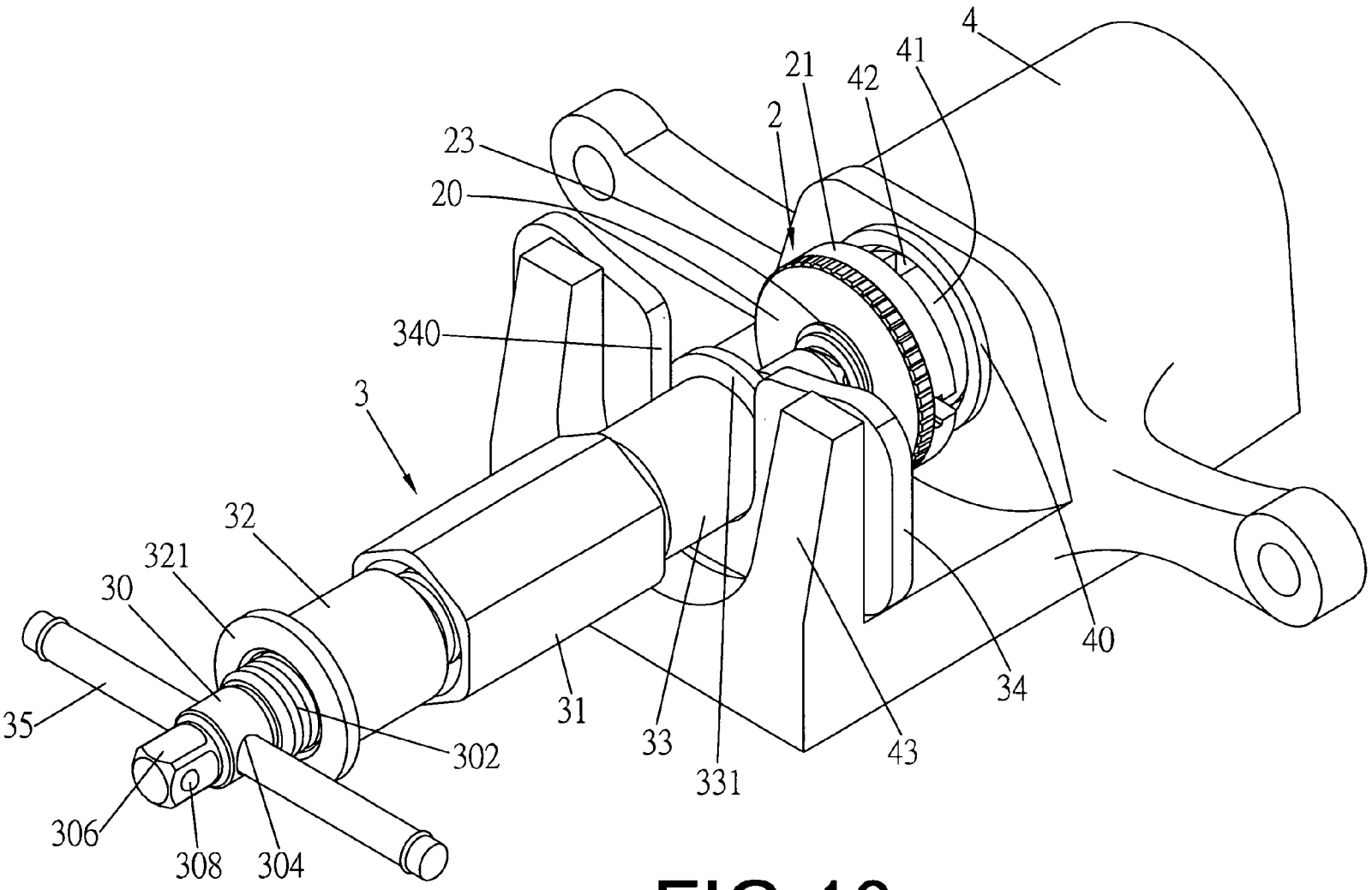
FIG. 10 is a perspective view to show the brake cylinder adjustment assembly of the present invention cooperated with the right brake cylinder.

When the right brake cylinder 4 is to be adjusted as shown in FIGS. 9 and 10, the rotation unit 2 is removed from left end of the driving unit 3, and the rotation unit 2 is connected to the right end part 307 of the operation rod 30 of the driving unit 3. The right positioning bead 309 of the right end part 307 is pushed inward by the inside of the polygonal hole 213, so that the right positioning bead 309 of the right end part 307 contacts the inside of the polygonal hole 213, and the rotation unit 2 is firmly connected to the right end part 307 of the driving unit 3. The driving rod 35 is removed from the right hole 305 of the driving unit 3 and then inserted through the left hole 304 of the driving unit 3. The board 34 is then connected to the caliper body 43 of the right brake cylinder 4 to connect the driving unit 3 and the right positioning socket 33 to the right brake cylinder 4. The right positioning socket 33 is engaged with the notch 340 of the board 34 and the caliper body 43 of the left brake cylinder 4. The positioning rods 22 of the rotation unit 2 are located corresponding to the recesses 42 of the outer side of the piston 41 of the right brake cylinder 4. The user holds the driving rod 35 to rotate the operation rod 30 of the driving unit 3 so that the driving unit 3 moves rotationally forward to drive the rotation unit 2 to move the piston 41 back to its initial position to complete the adjustment to the right brake cylinder 4.

The present invention uses only one driving unit 3 and one rotation unit 2 to adjust the brake cylinders of different sizes. The present invention is able to adjust the left and right brake cylinders to reduce users' economical burden and the brake cylinder adjustment assembly of the present invention is compact and light so as to be carried conveniently.

While we have shown and described the embodiment in accordance with the present invention, it should be clear to those skilled in the art that further embodiments may be made without departing from the scope of the present invention.

What is claimed is:

1. A brake cylinder adjustment assembly comprising:

a rotation unit having a rotatable disk, a fixed disk, at least two positioning rods and a clip, the rotatable disk having at least two curved slots defined at one side thereof and a through hole defined centrally through the rotatable disk, the fixed disk having at least two slide slots extending from a first side to a second side thereof and two positioning slots defined at the second side of the fixed disk and located corresponding to the at least two slide slots, a protrusion extending from the second side of the fixed disk and capable of being inserted through the through hole of the rotatable disk, the protrusion having a polygonal hole defined therein and a groove defined at an outer surface of the protrusion, the clip is engaged with the groove, the at least two positioning rods engaged with the at least two slide slots of the fixed disk, each of the at least two positioning rods having a positioning flange at an end thereof and the two respective positioning flanges engaged with the positioning slots of the fixed disk, each of the positioning flanges having a guide extending therefrom which is engaged with the curved slot corresponding thereto, and a driving unit having an operation rod, a left positioning socket, a right positioning socket, a board and a driving rod, the operation rod having a left threaded section and a right threaded section respectively formed at left and right sections thereof, a left hole defined through the operation rod and located close to one end of the left threaded section, a right hole defined through the operation rod and located close to one end of the right threaded section, a polygonal left end part and a polygonal right end part respectively extending from two ends of the operation rod, the left end part having a left positioning bead retractably engaged with one side thereof, the polygonal right end part having a right positioning bead retractably engaged with one side thereof, the left positioning socket having inner threads defined therein and the right positioning socket having inner threads defined therein, the left positioning socket and the right positioning socket respectively and threadedly connected to the left threaded section and the right threaded section, the left positioning socket having a first flange and the right positioning socket having a second flange, the board having a notch, the left positioning socket or the right positioning socket engaged with the notch of the board, the driving rod capable of being inserted through the left hole or the right hole of the operation rod.

2. The assembly as claimed in claim 1, wherein the operation rod has an annular protrusion provided at a middle section thereof and an annular groove is defined at an outer surface of the annular protrusion, a fixed socket is mounted to the middle section of the operation rod, the fixed socket has a polygonal outer body and a passage is defined axially through the fixed socket, a lip extends from an inner surface of the fixed socket that defines the passage and the lip is engaged with the annular groove of the annular protrusion.

3. The assembly as claimed in claim 1, wherein the rotatable disk has an anti-slip surface defined at a circumference thereof.

* * * * *